US007628710B2

(12) United States Patent
Kumamoto

(10) Patent No.: US 7,628,710 B2
(45) **Date of Patent: *Dec. 8, 2009**

(54) GOLF CLUB SHAFT

(75) Inventor: Tomio Kumamoto, Hyogo (JP)

(73) Assignee: SRI Sports Limited, Kobe (JP)

( * ) Notice: Subject to any disclaimer, the term of this patent is extended or adjusted under 35 U.S.C. 154(b) by 253 days.

This patent is subject to a terminal disclaimer.

(21) Appl. No.: 11/516,640

(22) Filed: Sep. 7, 2006

(65) Prior Publication Data

US 2007/0105644 A1 May 10, 2007

(30) Foreign Application Priority Data

Nov. 8, 2005 (JP) ..... 2005-323151

(51) Int. Cl.
*A63B 53/10* (2006.01)

(52) U.S. Cl. ..... 473/319

(58) Field of Classification Search ..... 473/319
See application file for complete search history.

(56) References Cited

U.S. PATENT DOCUMENTS

| | | | | |
|---|---|---|---|---|
| 6,056,648 | A * | 5/2000 | Kusumoto et al. | 473/319 |
| 6,540,623 | B2 * | 4/2003 | Jackson | 473/319 |
| 2003/0072706 | A1 * | 4/2003 | Kawakami et al. | 423/445 R |
| 2004/0038251 | A1 * | 2/2004 | Smalley et al. | 435/6 |
| 2004/0043895 | A1 * | 3/2004 | Louwet et al. | 502/159 |
| 2004/0054151 | A1 * | 3/2004 | Dorn et al. | 534/15 |
| 2005/0152891 | A1 * | 7/2005 | Toone et al. | 424/125 |

FOREIGN PATENT DOCUMENTS

| | | | |
|---|---|---|---|
| JP | 2004-188191 | A | 7/2004 |
| JP | 2004-298357 | A | 10/2004 |
| JP | P2005-105152 | A * | 4/2005 |

* cited by examiner

*Primary Examiner*—Stephen L. Blau
(74) *Attorney, Agent, or Firm*—Birch, Stewart, Kolasch & Birch, LLP

(57) ABSTRACT

A golf club shaft composed of a laminate of prepregs. A part of the laminate is formed as a fullerene-containing bias layer BF composed of prepregs containing a matrix resin and fullerene and/or a fullerene compound contained in the matrix resin. Reinforcing fibers of the prepregs form an angle of not less than ±10° nor more than ±80° to the axis of the shaft.

7 Claims, 9 Drawing Sheets

GOLF CLUB SHAFT

This nonprovisional application claims priority under 35 U.S.C. § 119(a) on Patent Application No(s). 2005-323151 filed in Japan on Nov. 8, 2005, the entire contents of which are hereby incorporated by reference.

FIELD OF THE INVENTION

The present invention relates to a golf club shaft. More particularly, the present invention is intended to improve the strength of a golf club shaft made of a fiber reinforced resin.

DESCRIPTION OF THE RELATED ART

In recent years, to allow golfers to hit golf balls at high speeds and directionally stably, the present tendency is to make a golf club head heavy and make the golf club shaft as lightweight as possible. Therefore as the material of the golf club shaft, the fiber reinforced resin such as a carbon prepreg that is lightweight and has a high specific strength and a high specific rigidity is mainly used.

Owing to a low birth rate, there is a tendency for senior golfers to increase in the future. Thus there is a growing demand for the development of a golf club suitable for senior golfers. Because seniors are powerless, the golf club for them is demanded to be lightweight and have a high head speed so that flight distances of golf balls are constant. To increase the head speed, it is necessary to make the shaft soft and flexible. To this end, methods of decreasing the number of fiber layers of the shaft made of the fiber reinforced resin, decreasing the modulus of elasticity of fibers, and differentiating fiber angles from each other are conventionally used.

But shafts manufactured by using these methods have a low strength. Thus it is difficult to manufacture a shaft which has a light weight, a high flexibility, a high strength, and a high directional stability in hit balls.

To overcome the above-described problem, there are proposed golf club shafts as disclosed in Japanese Patent Application Laid-Open Nos. 2004-298357 (patent document 1) and 2004-188191 (patent document 2). In these patent documents, at least one part of the fiber reinforced resin layers composing the shaft contains the carbon nano-tube. According to the description made in the specification of the patent documents, the shaft is allowed to have a restrained bending rigidity, a light weight, and a high strength.

The carbon nano-tube is a faultless single layer tubular material formed by cylindrically rounding a flat hexagonal net of graphite or a multi-layer tubular material composed of hexagonal nets of graphite layered one upon another in a telescopic system. The carbon nano-tube is a superfine carbon fiber having a diameter in the range of 1 nm to 100 nm and has mechanical properties superior to conventional carbon fiber in its torsional strength and bending strength.

Because the carbon nano-tubes are cylindrical, they have a low fluidity and are liable to aggregate with one another. To make the sizes (longitudinal length) of the carbon nano-tubes equal to each other, it is necessary to precisely control an arc discharge which takes place between carbon electrodes in manufacturing the carbon nano-tubes. It is difficult to manufacture the carbon nano-tubes having a uniform size. Therefore variations are liable to occur in the strength distribution of the fiber reinforced resin containing the carbon nano-tubes.

Patent document 1: Japanese Patent Application Laid-Open No. 2004-298357

Patent document 2: Japanese Patent Application Laid-Open No. 2004-188191

SUMMARY OF THE INVENTION

The present invention has been made in view of the above-described problems. Therefore it is an object of the present invention to provide a golf club shaft that is lightweight and has a proper degree of flexibility and strength.

To achieve the object, the present invention provides a golf club shaft composed of a laminate of prepregs each containing a matrix resin and reinforcing fibers impregnated with said matrix resin. The reinforcing fibers of a part of said prepregs layered one upon another incline to an axis of said golf club shaft to form at least one bias layer; and fullerene and/or a fullerene compound is mixed with said matrix resin of at least one part of said prepregs composing said bias layer respectively to form at least one fullerene-containing bias layer.

The fullerene is a carbon allotrope having a three-dimensional hollow spherical configuration closed with covalent bonds of sp2 carbon atoms. As the molecular structure of the fullerene, carbon atoms construct five-membered rings and six-membered rings, thus constructing a polyhedron. Representative fullerene is soccer ball-shaped C60 composed of 60 carbon atoms constructing 12 five-membered rings and 20 six-membered rings. The C60 is inexpensive, can be mass-produced, and is physically stable. In addition to C60, it is possible to use C70, C74, C76, C78, C80, C82, C84 and C90. They can be used singly or in combination.

As the fullerene compound, it is possible to use halogen-introduced C60Fn (n=30 through 52), C60C124, C60Brn (n=6, 8, 24), hydroxyl group-introduced C60(OH)24, hydrogen-added C60H24, a fullerene compound composed of the fullerene and metal such as Na, K, Rb or Cs doped in the crystal of the fullerene.

By mixing the fullerene or/and the fullerene compound (hereinafter often referred to as "fullerene and the like") with the matrix resin of the prepreg, it is possible to provide the shaft with an increased bending modulus of elasticity, an enhanced energy absorption performance, and a sufficient strength.

This is because the hollow spherical fullerene and the fullerene compound absorb a breaking energy, and in addition the fullerene and the resin combine with each other to form a firm crosslinking structure. Further the spherical fullerene is higher than the above-described cylindrical carbon nano-tube in its fluidity and dispersibility. Thus the fiber reinforced resin containing the hollow spherical fullerene has little variations in its strength.

Therefore even though the shaft is made flexible by other design element, the shaft is allowed to have a sufficient strength. Thereby the shaft is lightweight and flexible to such an extent that powerless players such as senior players can hit a ball a long distance. Further the shaft has a necessary strength.

As the fullerene to be used in the present invention, C60, C70, and C80 soluble in an organic solvent can be preferably used. To uniformly disperse the fullerene in the matrix resin, it is preferable to dissolve and disperse the fullerene and a monomer of the matrix resin in the organic solvent and evaporate the organic solvent by an evaporator.

After the fullerene is added to the matrix resin, it is preferable to knead them with a kneader, a three-roll or a biaxial extruder to disperse the fullerene in the matrix resin by utilizing a shear force.

To enhance the dispersibility of the fullerene, it is preferable to chemically treat the surface thereof with a surface-active agent such as polyoxyethylene lauryl ether.

It is possible to use the fullerene compound formed by bonding the fullerene such as C60, C70, and C80 to a functional group such as a hydroxyl group or metal atoms. In this case, it is possible to chemically bond the resin of the fiber reinforced resin or the surface of the reinforcing fiber with the functional group of the fullerene. Such a fullerene compound has improved affinity for the resin of the fiber reinforced resin and is hence capable of mixing with the resin to a high extent.

As the size of the fullerene or/and the fullerene compound to be added to the matrix resin, it is favorable that the average diameter of molecules thereof are not less than 0.6 nm nor more than 3.5 nm. The fullerene having an average diameter of less than 0.6 nm is theoretically present, but it is very difficult to collect or produce it. Further the fullerene whose average molecular diameter is less than 0.6 nm has a small area of contact between it and the fiber reinforced matrix resin. Consequently a weak bonding occurs between the fullerene and the matrix resin. Thereby the shaft has a low strength increase rate. When the average diameter of molecules of the fullerene or/and the fullerene compound are more than 3.5 nm, the molecules of the fullerene are very large. Thereby the fullerene has a low degree of dispersibility in the matrix resin of the fiber reinforced resin. Consequently a weak bonding occurs between the matrix resin and the fullerene or/and the fullerene compound. Thereby the shaft has a low strength. The lower limit of the average diameter of the molecules of the fullerene or/and the fullerene compound is set to more favorably 0.7 nm and most favorably 0.75 nm. The upper limit of the average diameter of the molecules thereof is favorably 3.2 nm and most favorably 2.8 nm.

As described above, the strength of the shaft and the directional stability of hit balls are effectively enhanced by using the prepreg containing the fullerene and the like as the bias layer of the shaft.

More specifically, in the present invention, the fullerene and the like are contained in the prepreg composing the bias layer to enhance the modulus of elasticity. Thereby it is possible to enhance the torsional rigidity and torsional strength of the shaft. By enhancing the torsional rigidity of the shaft, it is possible to reduce a change in the orientation of the head and enhance the directional stability of hit balls. By enhancing the torsional strength, the shaft is capable of flexing (flexible in a shaft-bent direction) to a high extent and having a high strength. Thereby the shaft flexes greatly in the shaft-bent direction and is capable of hitting a ball a long distance. That is, by enhancing the torsional rigidity of the shaft, the directional stability thereof can be enhanced. By enhancing the torsional strength thereof, the strength thereof can be enhanced.

The fullerene and the like do not necessarily have to disposed in all bias layers. For example, in forming a plurality of bias layers, only a part of the bias layers may contain the fullerene and the like. As another example, only a portion of a part of the bias layers may be composed of a fullerene-containing prepreg.

In a strict sense, the bias layer means a layer in which the reinforcing fibers form an angle of not less than ±10° nor more than ±80° to the axis of the shaft.

In addition to the bias layer, the fullerene and the like may be contained in a straight layer in which the reinforcing fibers form an angle of 0° to ±10° to the axis of the shaft and a hoop layer in which the reinforcing fibers form an angle of ±80° to 90° to the axis of the shaft. But it is most favorable that the fullerene and the like is contained in only the bias layer.

This is for the following reason: The addition of the fullerene and the like to the straight layer allows the shaft to have a high bending strength, but increases the bending rigidity thereof and decreases the flexibility thereof. Thereby the shaft has a low head speed and is hence incapable of hitting a ball a long distance.

The addition of the fullerene and the like to the hoop layer allows the shaft to have a high breaking strength and a high breaking rigidity. In the hoop layer, the fibrous direction is orthogonal to the axis of the shaft. Thus it is difficult to mold the wound hoop layer containing the fullerene and the like. In some cases, defective molding of the wound hoop layer occurs (wrinkles). Thereby the shaft has a low strength. When the prepreg composing the hoop layer is hard because the prepreg contains the fullerene and the like, the moldability of the wound prepreg is very low.

When it is necessary to increase the breaking rigidity and strength of the shaft, the fullerene and the like may be contained in the hoop layer and the straight layer in addition to the bias layer. But in this case, it is preferable to adjust the breaking rigidity and strength of the shaft of the shaft by using the technique of decreasing the modulus of elasticity of the reinforcing fibers, thinning the reinforcing fibers, and increasing the amount of resin.

In this case, favorably, the number of fullerene-containing hoop layers+the number of fullerene-containing straight layers≦the number of fullerene-containing bias layers. More favorably, the number of fullerene-containing hoop layers+the number of fullerene-containing straight layers<the number of fullerene-containing bias layers.

To allow the shaft to securely flex and improve the torsional rigidity and torsional strength thereof, the lower limit of the angle of the reinforcing fibers of the fullerene-containing bias layer to the axis of the shaft is favorably 20°, more favorably 30°, and most favorably 40°. The upper limit of the angle of the reinforcing fibers of the fullerene-containing bias layer to the axis of the shaft is favorably 70°, more favorably 60°, and most favorably 50°.

Regarding the position of the fullerene-containing bias layer in the axial direction of the shaft, it is preferable that the fullerene-containing bias layer is disposed in a region including the head-side tip portion of the shaft. More specifically, (a) The fullerene-containing bias layer is disposed over the full length of the shaft.

(b) The fullerene-containing bias layer is disposed at the head-side tip portion of the shaft.

When the above-described (a) is selected, it is possible to improve the strength of the entire shaft. When the above-described (b) is selected, it is possible to improve the strength of the shaft and reduce the cost of manufacturing the shaft.

When the above-described (b) is selected, it is favorable to form the fullerene-containing bias layer at the head-side tip portion of the shaft in a length of 100 to 500 mm. If the length of the fullerene-containing bias layer is less than 100 mm, the strength of the shaft is improved to an insufficient extent. Therefore the length of the fullerene-containing bias layer is more favorably not less than 150 mm and most favorably not less than 200 mm. If the length of the fullerene-containing bias layer is more than 500 mm, the cost of manufacturing the shaft is high. Thus the length of the fullerene-containing bias layer is more favorably not more than 400 mm and most favorably not more than 350 mm.

In above-described (b), it is favorable that the length of the prepreg containing the fullerene or/and the fullerene compound is set to not less than 2% nor more than 90% of the full length of the shaft. If the length of the fullerene-containing prepreg is less than 2%, the shaft has a small fullerene-containing region and is thus insufficiently improved in its strength. The length of the fullerene-containing prepreg is set to more favorably not less than 4% and most favorably not less than 6% of the full length of the shaft. To improve the strength of the shaft, it is effective to widen the region in which the fullerene-containing prepreg is disposed. The shaft is expensive because the fullerene is very expensive. Therefore the length of the fullerene-containing prepreg is favorably not more than 90% and more favorably not more than 80%. The fullerene-containing bias layer may be disposed over the full length of the shaft like above-described (a). This construction allows the effect of the fullerene to be displayed to the maximum and hence enhances the strength of the entire shaft.

When the fullerene-containing bias layer is formed in only a part of the shaft, the use amount of the expensive fullerene decreases. Thereby a desired effect of the fullerene can be displayed at a low cost.

The full length of the golf club shaft is favorably not less than 800 mm nor more than 1270 mm. If the full length of the golf club shaft is less than 800 mm, the shaft is short and has a short flexing length. Thereby the shaft is incapable of displaying the effect to be brought about by the use of the fullerene and the like. On the other hand, if the full length of the golf club shaft is more than 1270 mm, the shaft is difficult to swing and hence unsuitable for powerless seniors. In addition, it is necessary to use a large amount of the fullerene for the long shaft to allow the shaft to display the effect to be brought about by the use of the fullerene. Thereby the cost of manufacturing the shaft is high. The lower limit of the full length of the golf club shaft is set to more favorably 820 mm and most favorably 840 mm. The upper limit of the full length thereof is set to more favorably 1245 mm and most favorably 1219 mm.

It is possible to effectively enhance the strength of the shaft by disposing the fullerene-containing bias layer at the head-side tip portion of the shaft to which a stress is collectively applied when a ball is hit. In addition, the fullerene-containing prepreg excellent in its bending modulus of elasticity and bending strength is capable of softening a high load applied to the head-side tip portion of the shaft when the ball is hit. Thereby it is possible to prevent the breakage of the shaft.

By disposing the fullerene-containing bias layer at the central portion of the shaft, it is possible to prevent the shaft from twisting when a golf club is swung up in a swing motion and thus swing down at a good timing. Thus the fullerene-containing bias layer disposed at the central portion of the shaft is effective for improving the directional stability of the hit ball and allowing a player to hit the ball a long distance.

When the fullerene-containing bias layer is formed at the grip-side of the shaft, it is possible to prevent the shaft from twisting during the motion of swinging down the golf club and is thus effective for improving the operability of the shaft. Further because the fullerene-containing prepreg is capable of softening a stress, a shock generated at a hitting time is softened and transmitted to golfer's hands to a low extent.

It is preferable to dispose the fullerene-containing prepreg in an intermediate layer sandwiched between an inner layer and an outer layer. It is particularly preferable to interpose the fullerene-containing prepreg between the bias layer whose fiber angle forms ±45° to the axis of the shaft and the straight layer whose fiber angle forms 0° to the axis thereof.

In a swing behavior, a force acting in a twist direction and a force acting in a bending direction are simultaneously applied to the shaft. By disposing the fullerene-containing prepreg between the bias layer and the straight layer having an effect for the forces acting in the twist direction and the bending direction respectively, the fullerene-containing prepreg softens a shear generated to a stress-generated direction when the layer between the bias layer and the straight layer twists, thereby preventing an interlaminar separation.

It is favorable that each prepreg composing said fullerene-containing bias layer contains said fullerene or/and said fullerene compound at not less than 0.002 wt % nor more than 2 wt % of the weight of said matrix resin.

When the content of the fullerene or/and the fullerene compound is less than 0.002 wt %, the fullerene content is so small that the fullerene-containing prepreg is incapable of sufficiently displaying the effect of improving the strength of the shaft. On the other hand, when the fullerene content is more than 2 wt %, an aggregation action of the fullerene or/and the fullerene compound occurs. Thereby the fullerene or/and the fullerene compound have a low dispersibility in the matrix resin. Consequently the fullerene-containing prepreg has a variation in the strength thereof and hence a low strength.

The lower limit of the fullerene content is set to favorably 0.005 wt %, more favorably 0.008 wt %, and most favorably 0.01 wt % of the weight of the matrix resin. The upper limit of the fullerene content is set to favorably 1.8 wt % and more favorably 1.6 wt % of the weight of the matrix resin.

As described above, according to the present invention, the fullerene or/and the fullerene compound both having a high energy absorption performance is contained in the bias layer. Thereby it is possible to restrain an increase in the weight of the shaft and in the bending rigidity thereof and yet uniformly and effectively enhance the torsional strength and torsional rigidity thereof. Therefore the shaft of the present invention is lightweight, flexible, and high in the directional stability of hit balls. Thus the shaft allows powerless players such as seniors to hit the ball a long distance and has a high strength.

Each prepreg composing said fullerene-containing bias layer contains said fullerene or/and said fullerene compound at not less than 0.002 wt % nor more than 2 wt % of the weight of said matrix resin. Thereby the fullerene and the like are capable of effectively improving the strength of the shaft within a range in which the aggregation action of the fullerene or/and the fullerene compound does not occur.

DETAILED DESCRIPTION OF THE PREFERRED EMBODIMENTS

Figure 1:
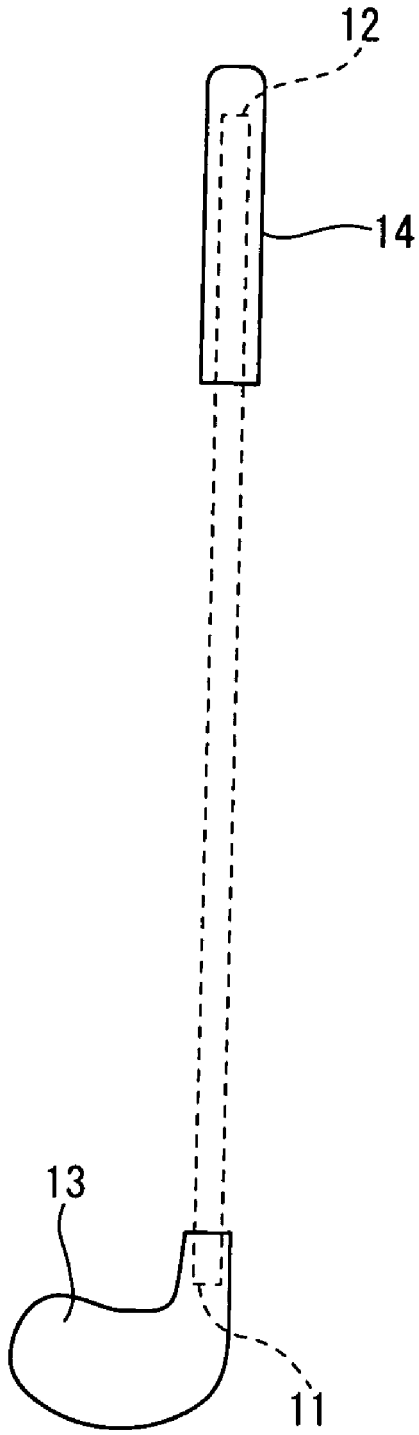
FIG. 1 is a schematic view showing a golf club shaft according to a first embodiment of the present invention.

The embodiments of the present invention will be described below with reference to the drawings.

FIGS. 1 through 4 show a golf club shaft (hereinafter often referred to as merely shaft) 10 according to a first embodiment of the present invention. The shaft 10 is composed of a tapered long tubular body composed of a laminate of prepregs 21 through 28. A head 13 is mounted on a head-side tip 11 of the shaft 10 having a smaller diameter. A grip 14 is mounted on a grip-side butt 12 thereof having a larger diameter.

The full length of the shaft 10 is set to 1168 mm. The weight of the shaft 10 is set to 50 g.

Figure 2:
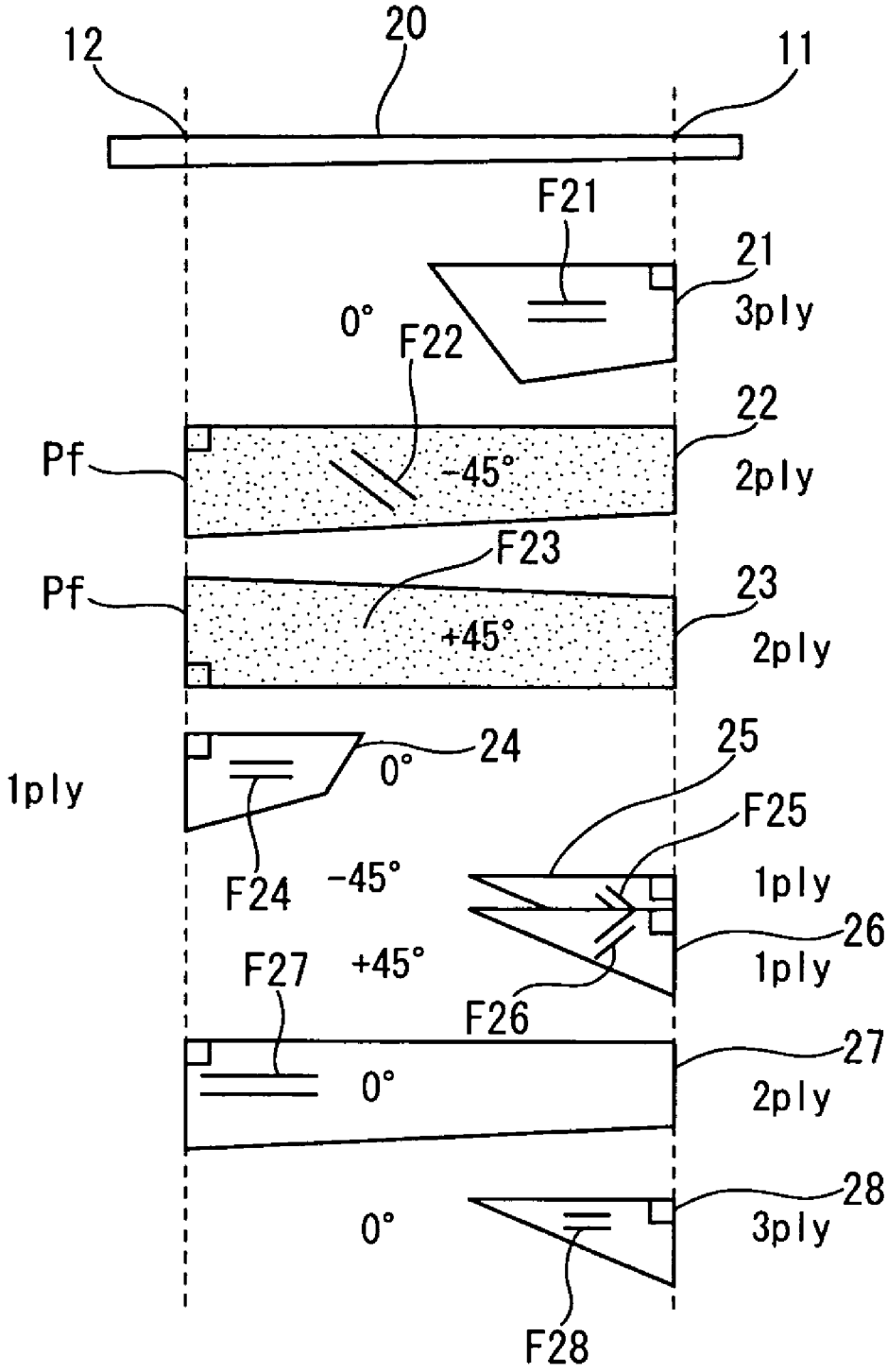
FIG. 2 shows a layered construction of prepregs of the golf club shaft shown in FIG. 1.

As shown in FIG. 2, the shaft 10 is manufactured as follow: Eight prepregs 21 through 28 are sequentially wound in the order from the prepreg 21 to the prepreg 28 and layered around a mandrel 20 by using a sheet winding method. Thereafter to perform integral molding, a tape (not shown) made of polypropylene is wound around the laminate of the prepregs 21 through 28. After the laminate around which the tape has been wound is heated in an oven under pressure to harden the resin, the mandrel 20 is drawn out of the laminate. After the surface of the shaft 10 is polished, both ends thereof are cut. Then the shaft 10 is painted.

Of the prepregs 21 through 28, the second-layer prepreg 22 and the third-layer prepreg 23 are formed as a fullerene-containing prepreg pf respectively.

Including the fullerene-containing prepregs 22, 23, epoxy resin is used as the matrix resin of the prepregs 21 through 28. Carbon fibers are used as reinforcing fibers F21 through F28.

Figure 3:
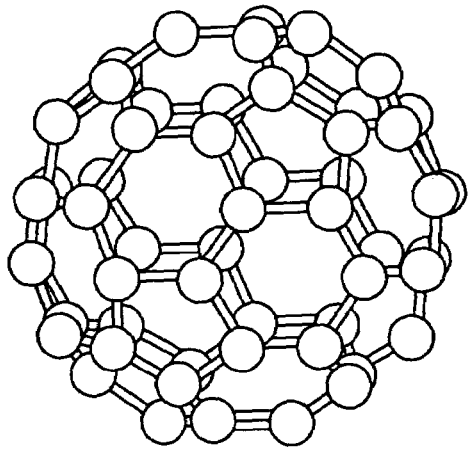
FIG. 3 shows the molecular structure of fullerene contained in the golf club shaft shown in FIG. 1.

The fullerene-containing prepreg pf is formed as follows: Fullerene (C60) having a soccer ball-shaped hollow spherical configuration is added to the epoxy resin, as shown in FIG. 3. Thereafter the epoxy resin and the fullerene are kneaded. The carbon fibers F22, F23 are immersed in the epoxy resin containing the fullerene C60 therein.

In the first embodiment, the content of the fullerene contained in each of the fullerene-containing prepregs pf is set to 0.02 wt % of the entire weight of the epoxy resin.

The fullerene is dissolved in an organic solvent before the fullerene is mixed with the epoxy resin. After molecules of the fullerene are uniformly dispersed in the organic solvent, the fullerene is mixed with the monomer of the epoxy resin.

The construction of each of the layered prepregs 21 through 28 is described below, with reference to FIG. 2.

Figure 4:
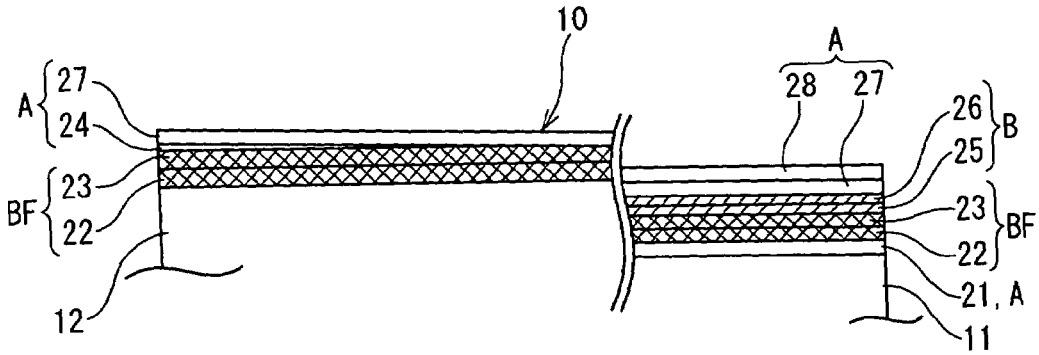
FIG. 4 is a partial explanatory view for describing a vertical sectional surface of the golf club shaft shown in FIG. 1.

The innermost first-layer prepreg 21 is disposed at the head-side tip portion of the shaft 10. The mandrel 20 is wound with three turns (three plies) of the first-layer prepreg 21. The first-layer prepreg 21 has a length of 220 mm and a thickness of 0.1052 mm. The reinforcing fiber F21 forms an angle of 0° to the axis of the shaft 10. As shown in FIG. 4, the first-layer prepreg 21 forms a straight layer A in a state in which the shaft has been formed by molding the prepregs.

The second-layer prepreg 22 is formed as the fullerene-containing prepreg pf and disposed over the full length of the shaft 10. The mandrel 20 is wound with two turns (two plies) of the second-layer prepreg 22. The second-layer prepreg 22 has a thickness of 0.1052 mm. The reinforcing fiber F22 has an angle of −45° to the axis of the shaft 10. As shown in FIG. 4, the second-layer prepreg 22 forms a fullerene-containing bias layer BF in the state in which the shaft has been formed by molding the prepregs.

The third-layer prepreg 23 is also formed as the fullerene-containing prepreg pf and disposed over the full length of the shaft 10. The mandrel 20 is wound with two turns (two plies) of the third-layer prepreg 23. The third-layer prepreg 23 has a thickness of 0.1052 mm. The reinforcing fiber F23 has an angle of ±45° to the axis of the shaft 10. As shown in FIG. 4, the third-layer prepreg 23 also forms the fullerene-containing bias layer BF in the state in which the shaft has been formed by molding the prepregs.

The fourth-layer prepreg 24 is disposed at the grip-side butt of the shaft 10. The mandrel 20 is wound with one turn (one ply) of the fourth-layer prepreg 24. The fourth-layer prepreg 24 has a length of 300 mm and a thickness of 0.0842 mm. The reinforcing fiber F24 forms the angle of 0° to the axis of the shaft 10. As shown in FIG. 4, the fourth-layer prepreg 24 forms the straight layer A in the state in which the shaft has been formed by molding the prepregs.

The fifth-layer prepreg 25 is disposed at the head-side tip portion of the shaft 10. The mandrel 10 is wound with one turn (one ply) of the fifth-layer prepreg 25. The fifth-layer prepreg 25 has a length of 300 mm and a thickness of 0.0842 mm. The reinforcing fiber F25 forms the angle of −45° to the axis of the shaft 10. As shown in FIG. 4, the fifth-layer prepreg 25 forms a bias layer B in the state in which the shaft has been formed by molding the prepregs.

The sixth-layer prepreg 26 is disposed at the head-side tip portion of the shaft 10. The mandrel 10 is wound with one turn (one ply) of the sixth-layer prepreg 26. The sixth-layer prepreg 26 has a length of 300 mm and a thickness of 0.0842 mm. The reinforcing fiber F26 forms the angle of +45° to the axis of the shaft 10. As shown in FIG. 4, the sixth-layer prepreg 26 also forms the bias layer B in the state in which the shaft has been formed by molding the prepregs.

The seventh-layer prepreg 27 is disposed over the full length of the shaft 10. The mandrel 10 is wound with two turns (two plies) of the seventh-layer prepreg 27. The seventh-layer prepreg 27 has a thickness of 0.1052 mm. The reinforcing fiber F27 forms the angle of 0° to the axis of the shaft 10. As shown in FIG. 4, the seventh-layer prepreg 27 forms the straight layer A in the state in which the shaft has been formed by molding the prepregs.

The outermost eighth-layer prepreg 28 is disposed at the head-side tip portion of the shaft 10. The mandrel 10 is wound with three turns (three plies) of the eighth-layer prepreg 28. The eighth-layer prepreg 28 has a length of 250 mm and a thickness of 0.0842 mm. The reinforcing fiber F28 forms the angle of 0° to the axis of the shaft 10. As shown in FIG. 4, the eighth-layer prepreg 28 also forms the straight layer A in the state in which the shaft has been formed by molding the prepregs.

The shaft 10 having the above-described construction has the fullerene-containing bias layer BF disposed over the full length thereof. Therefore it is possible to enhance the torsional rigidity and torsional strength of the entire shaft. Hence it is possible to improve the directional stability of a hit ball and relieve a torsional deformation of the shaft when a golf club is swung and when the ball is hit. Thereby it is possible to prevent the breakage of the shaft. Because the fullerene and the like are not contained in the straight layer, it is possible to restrain an increase of the bending rigidity and secure a proper degree of flexibility. Thus even powerless seniors can hit balls a long distance.

Each of the prepregs 22, 23 composing said fullerene-containing bias layer contains said fullerene or/and said fullerene compound at 0.02 wt % of said matrix resin that is not less than 0.002 wt % nor more than 2 wt % of the weight of said matrix resin. Therefore it is possible to uniformly enhance the torsional rigidity and torsional strength of the shaft without aggregation action of the fullerene.

Figure 5:
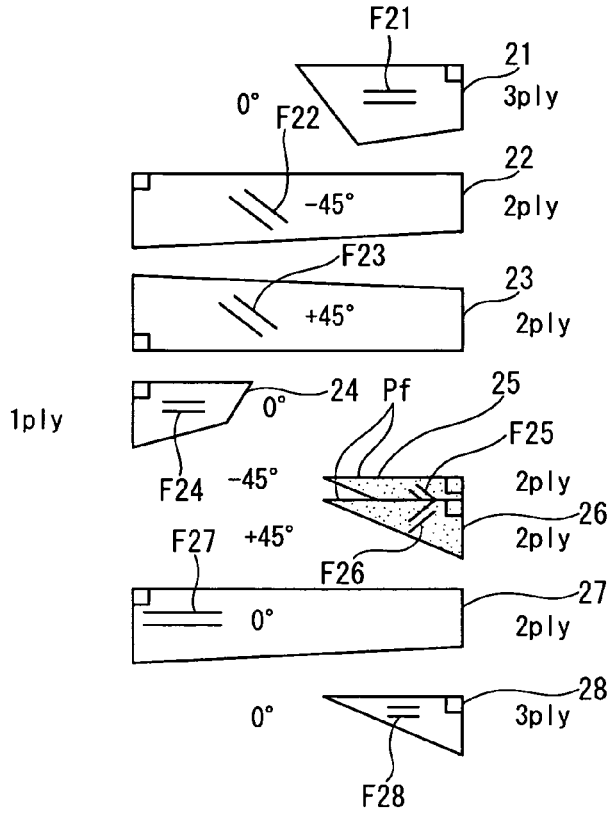
FIG. 5 shows a layered construction of prepregs of a golf club shaft according to a second embodiment of the present invention.
Figure 6:
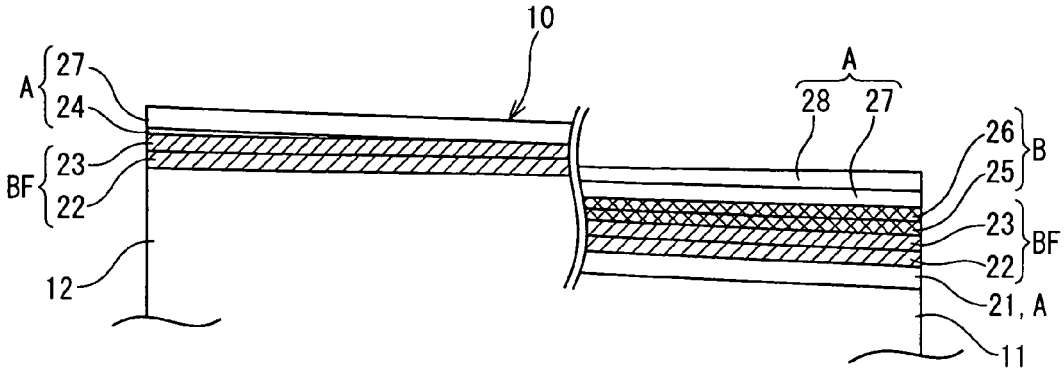
FIG. 6 is a partial explanatory view for describing a vertical sectional surface of the golf club shaft shown in FIG. 5.

FIGS. 5 and 6 show the second embodiment. A fifth-layer prepreg 25 and a sixth-layer prepreg 26 are composed of the fullerene-containing prepreg pf. The fifth-layer prepreg 25 and the sixth-layer prepreg 26 form the fullerene-containing bias layer BF respectively at the head side of the shaft 10.

More specifically, the fifth-layer prepreg 25 and the sixth-layer prepreg 26 are disposed at the head-side tip portion of the shaft 10. The mandrel 20 is wound with two turns (two plies) of the fifth-layer prepreg 25 and the sixth-layer prepreg 26. Each of the fifth-layer prepreg 25 and the sixth-layer prepreg 26 has a length of 300 mm and a thickness of 0.0842 mm. The reinforcing fibers F25 and F26 form an angle of −45° and +45° respectively to the axis of the shaft 10.

The second-layer prepreg 22 and the third-layer prepreg 23 do not contain the fullerene.

The constructions of the other prepregs 21, 24, 27, and 28 layered one upon another are identical to those of the prepregs 21, 24, 27, and 28 of the first embodiment.

In the second embodiment, the fullerene-containing bias layer BF is formed at only the head-side tip portion of the shaft 10 to which a largest stress is applied when a ball is hit. The mandrel is wound with two turns of the prepregs 25, 26 constructing the fullerene-containing bias layer BF. Thereby it is possible to restrain a torsional deformation of the tip portion of the shaft and effectively prevent breakage of the shaft. Further it is possible to enhance the directional stability of hit balls and flight distance of a hit ball. Furthermore it is possible to restrain an increase in the shaft-manufacturing cost because the expensive fullerene is used partly for the shaft.

Figure 7:
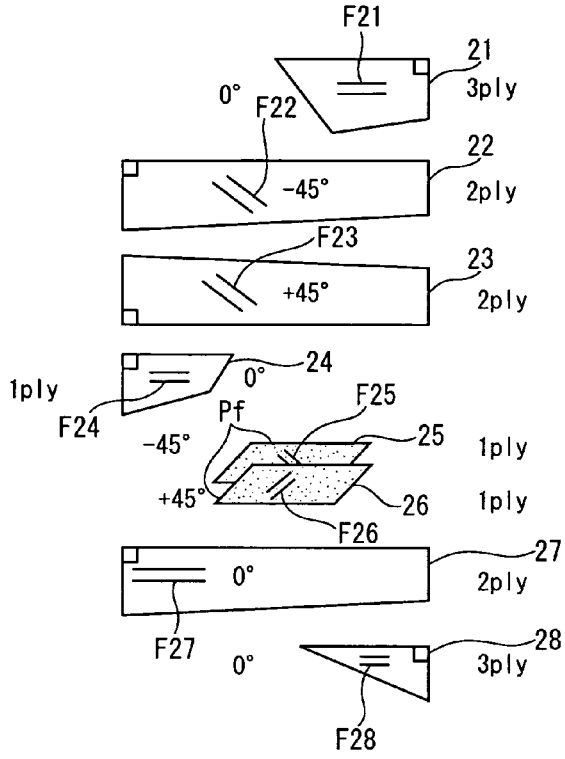
FIG. 7 shows a layered construction of prepregs of a golf club shaft according to a third embodiment of the present invention.
Figure 8:
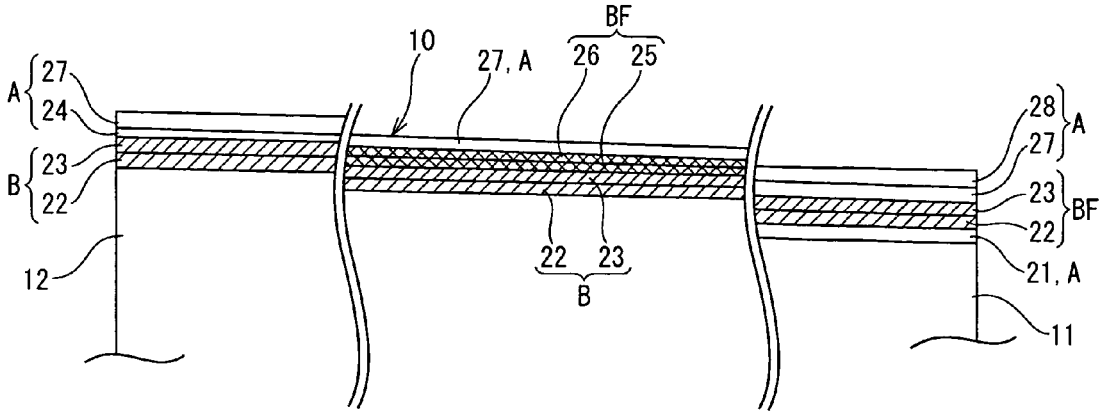
FIG. 8 is a partial explanatory view for describing a vertical sectional surface of the golf club shaft shown in FIG. 7.

FIGS. 7 and 8 show the third embodiment of the present invention. A fifth-layer prepreg 25 and a sixth-layer prepreg 26 are composed of the fullerene-containing prepreg pf. The fifth-layer prepreg 25 and the sixth-layer prepreg 26 form the fullerene-containing bias layer BF respectively at a central portion of the shaft 10.

More specifically, the fifth-layer prepreg 25 and the sixth-layer prepreg 26 are disposed at the central portion of the shaft 10, namely, at a portion spaced at an interval of 200 mm to 550 mm from the head-side tip 11. The mandrel 20 is wound with one turn (one play) of the fifth-layer prepreg 25 and the sixth-layer prepreg 26. Each of the fifth-layer prepreg 25 and the sixth-layer prepreg 26 has a thickness of 0.0842 mm. The reinforcing fibers F25 and F26 form the angle of −45° and +45° respectively to the axis of the shaft 10.

The constructions of the other prepregs 21-24, 27, and 28 layered one upon another are identical to those of the prepregs 21-24, 27, and 28 of the second embodiment.

In the third embodiment, the fullerene-containing bias layer BF is formed at the central portion of the shaft 10 which affects the twist of the shaft when a golf club is swung up in a swing motion. Thus the twist of the shaft is restrained when the golf club is swung up, and hence the golf club can be swung down at a good timing.

Figure 9:
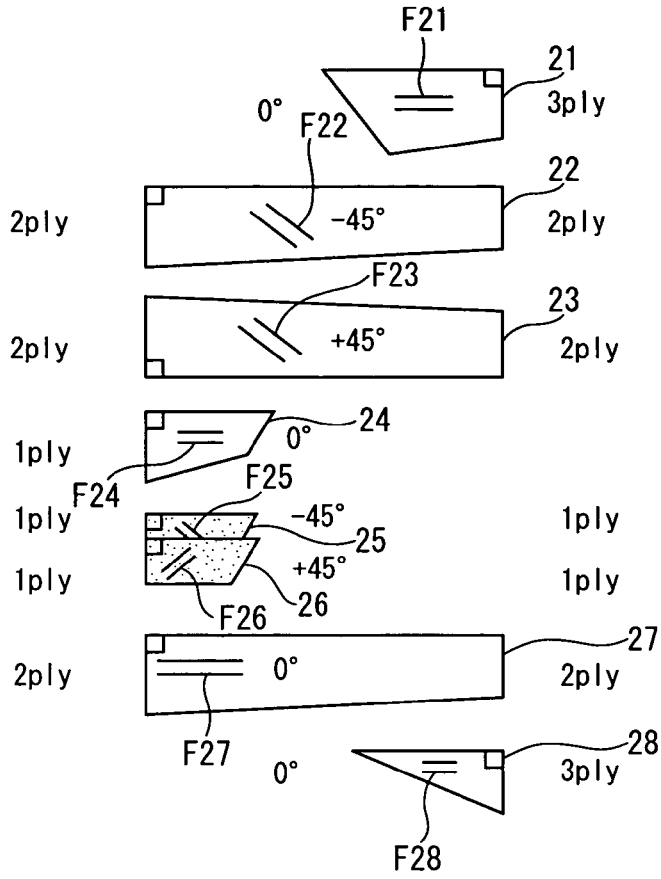
FIG. 9 shows a layered construction of prepregs of a golf club shaft according to a fourth embodiment of the present invention.
Figure 10:
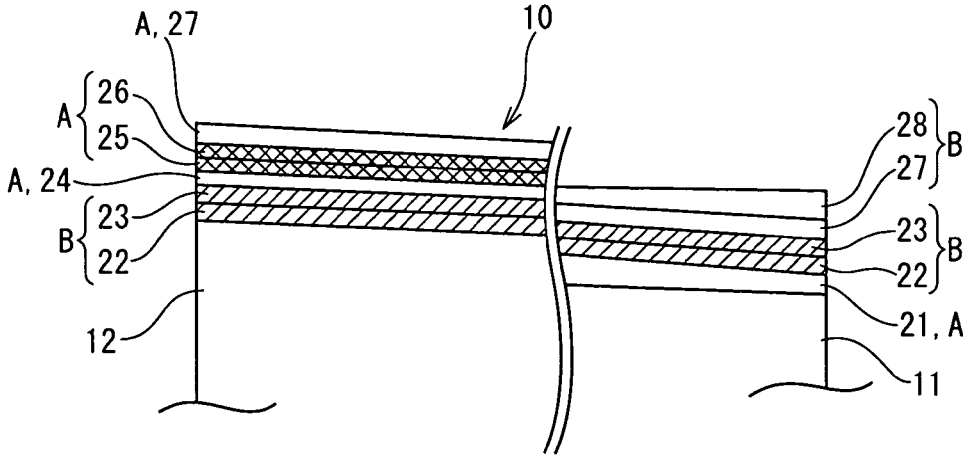
FIG. 10 is a partial explanatory view for describing a vertical sectional surface of the golf club shaft shown in FIG. 9.

FIGS. 9 and 10 show the fourth embodiment. A fifth-layer prepreg 25 and a sixth-layer prepreg 26 consisting of the above-described fullerene-containing prepreg pf form the fullerene-containing bias layer BF at the grip side of the shaft 10.

More specifically, each of the fifth-layer prepreg 25 and the sixth-layer prepreg 26 is disposed at the grip-side butt of the shaft 10. The mandrel 20 is wound with one turn (one play) of the fifth-layer prepreg 25 and the sixth-layer prepreg 26. Each of the fifth-layer prepreg 25 and the sixth-layer prepreg 26 has a length of 350 mm and a thickness of 0.0842 mm. The reinforcing fibers F25 and F26 form the angle of −45° and +45° respectively to the axis of the shaft 10.

The constructions of the other prepregs 21-24, 27, and 28 layered one upon another are identical to those of the prepregs 21-24, 27, and 28 of the second embodiment.

In the fourth embodiment, the fullerene-containing bias layer BF is formed at the grip side of the shaft 10 which affects the twist of the shaft when the golf club is swung down in the swing motion. Thus the twist of the shaft is restrained when the golf club is swung down and hence the golf club can be swung at a high operability.

EXAMPLES

To confirm the above-described operations and effects of the shafts, golf club shafts of the examples 1 through 5 of the present invention and those of comparison example 1 through 5 are described in detail below.

As shown in table 1, the golf club shafts of the examples 1 through 5 and those of comparison example 1 through 5 were prepared by differentiating the content of fullerene (wt % of fullerene and the like with respect to weight of matrix resin) contained in prepregs of the shafts, the angle of the reinforcing fibers of the fullerene-containing prepregs, the wound positions of the fullerene-containing prepregs (position where fullerene-containing layer is formed), and the number of turns of the fullerene-containing prepregs. A three-point bending strength and torsional strength of each of the golf club-shafts were measured, and a hitting test was conducted to examine the directional stability of hit balls. Table 1 shows the results.

TABLE 1

| | Comparison Example 1 | Comparison Example 2 | Comparison Example 3 | Comparison Example 4 | Comparison Example 5 |
|---|---|---|---|---|---|
| Content (wt %) of fullerene → percentage of fullerene with respect to weight of matrix resin | 0 | 0 | 0 | 0.02 | 0.02 |
| Fibrous angle (degree) of fullerene-containing prepreg | 45 | 45 | 45 | 0 | 90 |
| Position (position from tip of shaft) of fullerene-containing prepreg(mm) | 0~200 | 400~600 | 968~1168 | 0~200 | 0~200 |
| Number of plies of fullerene-containing prepreg | — | — | — | 2 | 2 |
| Length of shaft (mm) | 1168 | 1168 | 1168 | 1168 | 1168 |
| Directional stability | X | X | X | X | X |

TABLE 1-continued

| | | | | | |
|---|---|---|---|---|---|
| Three-point bending strength at point T(kgf) | 220 | 220 | 220 | 250 | 180 |
| Three-point bending strength at point A(kgf) | 90 | 90 | 90 | 88 | 88 |
| Three-point bending strength at point B(kgf) | 70 | 73 | 70 | 70 | 70 |
| Three-point bending strength at point C(kgf) | 80 | 80 | 82 | 80 | 80 |
| Torsional strength(N · mm) | 2800 | 2700 | 2600 | 2500 | 2000 |
| | Example 1 | Example 2 | Example 3 | Example 4 | Example 5 |
| Content (wt %) of fullerene → percentage of fullerene with respect to weight of matrix resin | 0.002 | 0.02 | 0.02 | 0.02 | 0.02 |
| Fibrous angle (degree) of fullerene-containing prepreg | 45 | 45 | 45 | 45 | 45 |
| Position (position from tip of shaft) of fullerene-containing prepreg(mm) | 0~200 | 0~200 | 0~1168 | 400~600 | 968~1168 |
| Number of plies of fullerene-containing prepreg | 2 | 2 | 1 | 1 | 1 |
| Length of shaft (mm) | 1168 | 1168 | 1168 | 1168 | 1168 |
| Directional stability | ○ | ◎ | ◎ | ○ | ○ |
| Three-point bending strength at point T(kgf) | 220 | 230 | 235 | 220 | 220 |
| Three-point bending strength at point A(kgf) | 90 | 92 | 92 | 90 | 90 |
| Three-point bending strength at point B(kgf) | 70 | 70 | 72 | 73 | 70 |
| Three-point bending strength at point C(kgf) | 80 | 80 | 82 | 80 | 82 |
| Torsional strength(N · mm) | 3200 | 3800 | 4000 | 3600 | 3400 |

In the shaft of each of the examples 1 through 5 and comparison example 1 through 5, the prepreg contained epoxy resin used as the matrix resin thereof and carbon fibers as the reinforcing fibers thereof. More specifically, the shafts were formed by the sheet winding method by using prepregs selected from four kinds of prepregs a through d produced by Toray Industries Inc. The producing method was identical to that used in the first embodiment.

The shafts of the examples and those of the comparison examples had an equal length of 1168 mm.

TABLE 2

| | Article No. | Resin | Fiber | Modulus of elasticity of fiber |
|---|---|---|---|---|
| Prepreg a | 3255G-12 | Tough Resin produced by Toray Industries Inc. | T700GC | 24t |
| Prepreg b | 9255S-7 | Tough Resin produced by Toray Industries Inc. | M40SC | 40t |
| Prepreg c | 8255S-12 | Tough Resin produced by Toray Industries Inc. | M30SC | 30t |
| Prepreg d | 2275F-12 | Modified resin produced by Toray Industries Inc. | T800SC | 30t |

The prepreg d was formed as the fullerene-containing prepreg as follows: The fullerene (C60) produced by Frontier Carbon Inc. was mixed with the modified resin produced by Toray Industries Inc. Carbon fibers (kind of fiber: T800SC) having a modulus of elasticity of 30 t was immersed in fullerene-containing epoxy resin.

The fullerene was not contained in any of the prepregs a, b, and c.

Example 1

The layered construction of prepregs was identical to that of the second embodiment. More specifically, a fifth-layer prepreg 25 and a sixth-layer prepreg 26 were formed as fullerene-containing prepregs. A mandrel was wound with two turns of the prepregs 25, 26 to form fullerene-containing bias layers in only a range spaced at an interval of 300 mm from the head-side tip of the shaft. Each of the prepregs 25, 26 contains said fullerene or/and said fullerene compound at not less than 0.002 wt % of the weight of said matrix resin, namely, the epoxy resin.

The prepreg a was used as the first layer 21. The prepreg b was used as the second layer 22 and the third layer 23. The prepreg c was used as the fourth layer 24. The prepreg d was used as the fifth layer 25 and the sixth layer 26. The prepreg c was used as the seventh layer 27. The prepreg c was used as the eighth layer 28.

Example 2

The shaft of the example 2 had the same prepreg-layered construction and the same content of the fullerene contained in the fullerene-containing prepreg as those of the shaft of the second embodiment. The shaft of the example 2 is different from that of the example 1 in that the content of the fullerene of each of the fifth and sixth layers was set to 0.02 wt %. In other constructions, the shaft of the example 2 was identical to that of the example 1.

Example 3

The shaft of the example 3 had the same prepreg-layered construction and the same content of the fullerene of the fullerene-containing prepreg as those of the shaft of the first embodiment. More specifically, a second-layer prepreg 22 and a third-layer prepreg 23 were formed as fullerene-containing prepregs. The mandrel was wound with two turns of the prepregs 22, 23 to form the fullerene-containing bias layers over the full length of the shaft. A fifth-layer prepreg 25 and a sixth-layer prepreg 26 did not contain the fullerene. The mandrel was wound with one turn of the prepregs 25, 26. The content of the fullerene of each of the prepregs 22, 23 was set to 0.02 wt % of the weight of the epoxy resin.

The prepreg a was used as the first layer 21. The prepreg d was used as the second layer 22 and the third layer 23. The prepreg c was used as the fourth layer 24. The prepreg c was used as the fifth layer 25 and the sixth layer 26. The prepreg c was used as the seventh layer 27. The prepreg c was used as the eighth layer 28.

Example 4

The shaft of the example 4 had the same prepreg-layered construction and the same content of the fullerene of the fullerene-containing prepreg as those of the shaft of the third embodiment. More specifically, a second-layer prepreg 22 and a third-layer prepreg 23 did not contain the fullerene. A fifth-layer 25 and a sixth-layer prepreg 26 were formed as fullerene-containing prepregs. The mandrel was wound with one turn of the prepregs 25, 26 to form the fullerene-containing bias layers in the range spaced at an interval of 200 mm to 550 mm from the head-side tip of the shaft. The content of the fullerene of each of the prepregs 25, 26 was set to 0.02 wt % of the weight of the epoxy resin.

The prepreg a was used as the first layer 21. The prepreg b was used as the second layer 22 and the third layer 23. The prepreg c was used as the fourth layer 24. The prepreg d was used as the fifth layer 25 and the sixth layer 26. The prepreg c was used as the seventh layer 27. The prepreg c was used as the eighth layer 28.

Example 5

The shaft of the example 5 had the same prepreg-layered construction and the same content of the fullerene of the fullerene-containing prepreg as those of the shaft of the fourth embodiment. More specifically, a second-layer prepreg 22 and a third-layer prepreg 23 did not contain the fullerene. A fifth-layer 25 and a sixth-layer prepreg 26 were formed as fullerene-containing prepregs. The mandrel was wound with one turn of the prepregs 25, 26 to form the fullerene-containing bias layers in the range spaced at an interval of 350 mm from the grip-side butt of the shaft. The content of the fullerene of each of the prepregs 25, 26 was set to 0.02 wt % of the weight of the epoxy resin.

The prepreg a was used as the first layer 21. The prepreg b was used as the second layer 22 and the third layer 23. The prepreg c was used as the fourth layer 24. The prepreg d was used as the fifth layer 25 and the sixth layer 26. The prepreg c was used as the seventh layer 27. The prepreg c was used as the eighth layer 28.

Comparison Example 1

The shaft of the comparison example 1 had the same prepreg-layered construction as that of the example 3. Any of the prepregs did not contain the fullerene.

More specifically, the prepreg a was used as the first layer 21. The prepreg b was used as the second layer 22 and the third layer 23. The prepreg c was used as the fourth layer 24. The prepreg c was used as the fifth layer 25 and the sixth layer 26. The prepreg c was used as the seventh layer 27. The prepreg c was used as the eighth layer 28.

Comparison Example 2

The shaft of the comparison example 2 had the same prepreg-layered construction as that of the example 4. Any of the prepregs did not contain the fullerene.

The prepreg a was used as the first layer 21. The prepreg b was used as the second layer 22 and the third layer 23. The prepreg c was used as the fourth layer 24. The prepreg c was used as the fifth layer 25 and the sixth layer 26. The prepreg c was used as the seventh layer 27. The prepreg c was used as the eighth layer 28.

Comparison Example 3

The shaft of the comparison example 1 had the same prepreg-layered construction as that of the example 5. Any of the prepregs did not contain the fullerene.

More specifically, the prepreg a was used as the first layer 21. The prepreg b was used as the second layer 22 and the third layer 23. The prepreg c was used as the fourth layer 24. The prepreg c was used as the fifth layer 25 and the sixth layer 26. The prepreg c was used as the seventh layer 27. The prepreg c was used as the eighth layer 28.

Comparison Example 4

Figure 11:
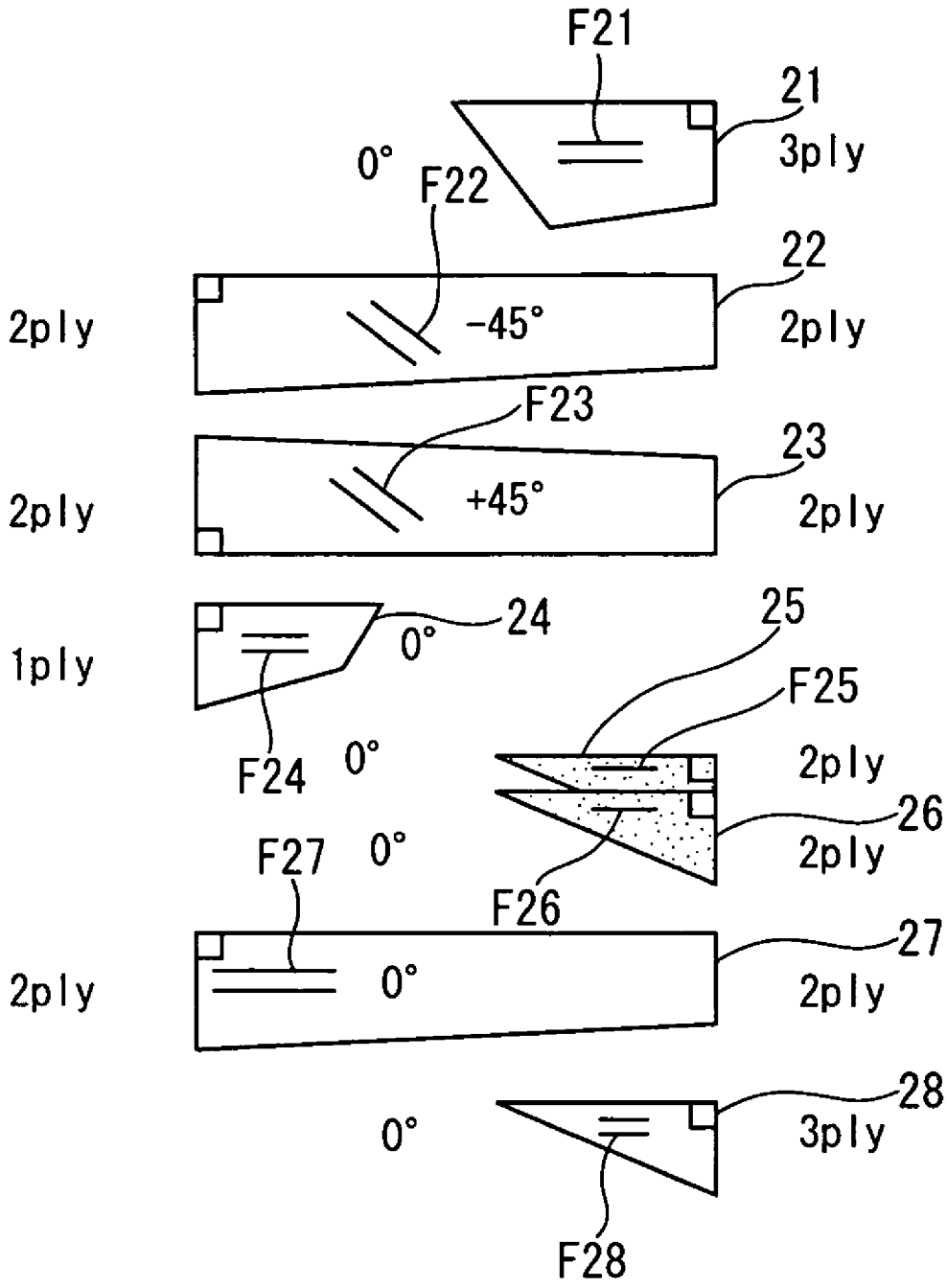
FIG. 11 shows a layered construction of prepregs of a golf club shaft of a comparison example 4.

The prepreg-layered construction was as shown in FIG. 11. In a fifth-layer prepreg 25 and a sixth-layer prepreg 26, carbon fibers F25, F26 formed an angle of 0° to the axis of the shaft. The mandrel was wound with two turns of the prepregs 25, 26 to form straight layers at the head-side tip portion of the shaft.

The shaft of the comparison example 4 is the same as that of the example 2 except that the fullerene-containing prepreg d was used as the prepregs 25, 26 composing the straight layer respectively and that the fullerene-containing straight layer was formed at the head-side tip portion of the shaft. The content of the fullerene of each of the prepregs 25, 26 was set to 0.02 wt % of the weight of the epoxy resin.

Comparison Example 5

Figure 12:
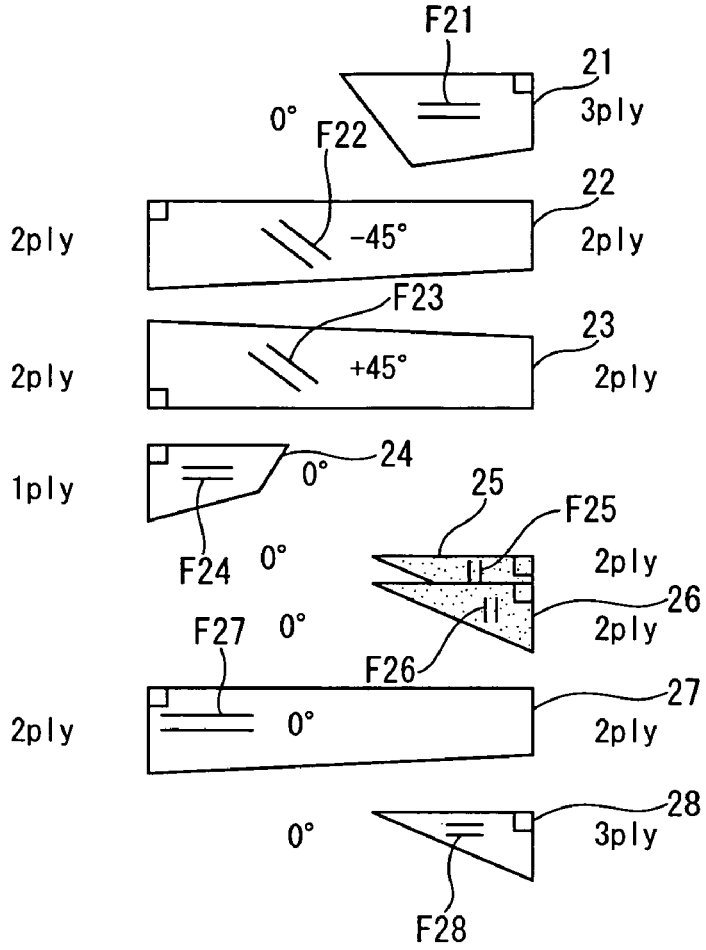
FIG. 12 shows a layered construction of prepregs of a golf club shaft of a comparison example 5.

The prepreg-layered construction was as shown in FIG. 12. In a fifth-layer prepreg 25 and a sixth-layer prepreg 26, carbon fibers F25, F26 formed an angle of 90° to the axis of the shaft. The mandrel was wound with two turns of the prepregs 25, 26 to form hoop layers at the head-side tip portion of the shaft.

In the comparison example 5, the shaft was the same as that of the example 2 except that the fullerene-containing prepreg d was used as the prepregs 25, 26 composing the hoop layer respectively and that the fullerene-containing hoop layer was formed at the head-side tip portion of the shaft. The content of the fullerene of each of the prepregs 25, 26 was set to 0.02 wt % of the weight of the epoxy resin.

Measurement of Three-Point Bending Strength

Figure 13:
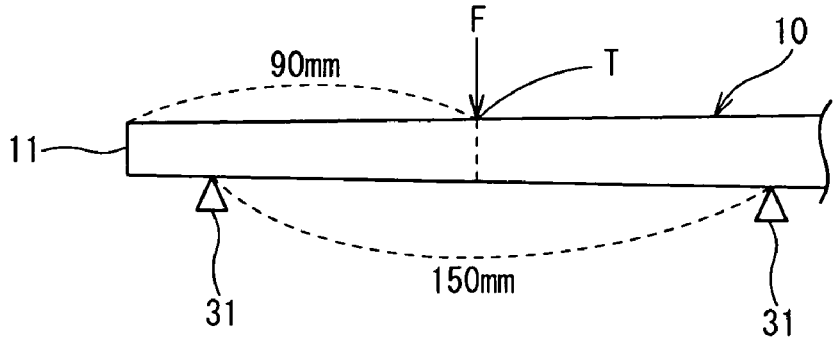
FIG. 13 shows a method of measuring a three-point bending strength.

The three-point bending strength means a breaking strength provided by the Product Safety Association. As shown in FIG. 13, a load F is applied from above to a shaft 10 supported at three points. A value (peak value) of the load when the shaft 10 was broken was measured. The bending strength was measured at points spaced at intervals of 90 mm (point T), 175 mm (point A), and 525 mm (point B) from the tip 11 of the shaft 10, respectively and a point spaced at an interval of 175 mm (point C) from the grip-side butt 12 of the shaft 10. The span between supporting points 31 was 150 mm when the bending strength was measured at the point T and 300 mm when the bending strength was measured at the points A, B, and C (FIG. 13 shows the case in which the bending strength was measured at the point T).

Measurement of Torsional Strength

Figure 14:
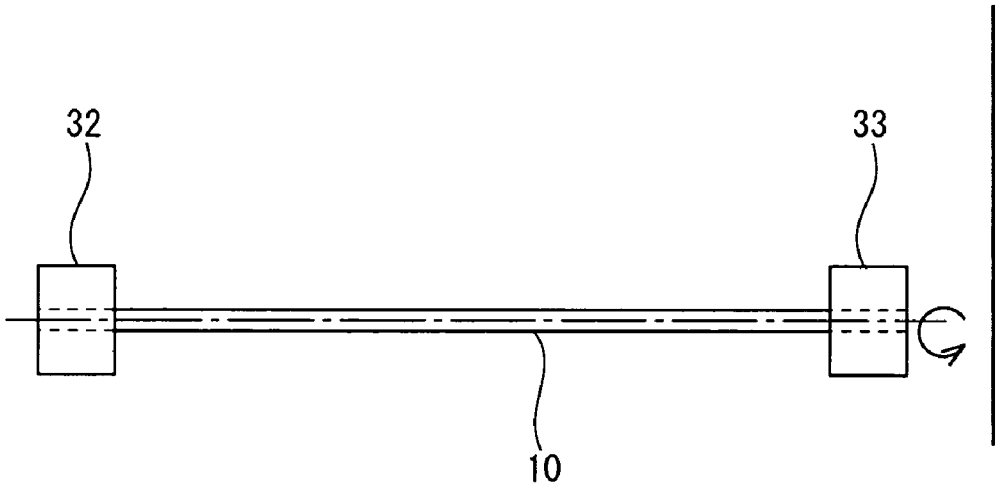
FIG. 14 shows a method of measuring a torsional strength.

The torsional strength means a breaking strength provided by the Product Safety Association. As shown in FIG. 14, both ends of the shaft 10 were fixed to jigs 32, 33. With one jig 32 kept stationary, the other jig 33 was rotated to twist the shaft 10. The product of a torque and a torsional angle at the time when the shaft 10 was broken was measured.

Hitting Test of Examining Directional Stability of Hit Ball

One player was requested to hit 20 balls. The shafts were evaluated as follows: Shafts which caused not less than eight balls to land off a target flight line by not less than ±20 yards were marked by X. Shafts which caused not less than five nor more than seven balls to land off the target flight line by not less than ±20 yards were marked by ○. Shafts which caused not more than four balls to land off the target flight line by not less than ±20 yards were marked by ◎. Table 1 shows the results.

As indicated in table 1, the shafts of the examples 1 through 5 were more favorable in directional stability of hit balls and higher in the torsional strength than the shafts of the comparison examples 1 through 5.

Regarding the bending strength, in the shafts of the example 2, 3 in which the prepreg d containing 0.02 wt % of the fullerene was disposed at essentially the range including the head-side tip portion, the bending strengths at the point T were a little higher than the bending strengths of the shafts of the other examples. The bending strengths of the shafts of the other examples at the points T, A, B, and C were almost equal to those of the shafts of the comparison examples. This is considered as follows: Because the shafts of the example 1 through 5 contained the fullerene in the bias layer thereof respectively, the shafts had a high torsional strength which affects the directional stability of hit balls, but the bending strength and the bending rigidity which influence the flexibility of the shaft were low.

The shaft of the example 3 in which the fullerene-containing prepreg d was disposed over the full length was more favorable in the directional stability of hit balls and higher in the torsional strength thereof than the shafts of the example 1, 2, 4, and 5 in which the fullerene-containing prepreg d was partly disposed. Regarding the bending strength, the shaft of the example 3 had a little higher bending strength at the point T than the shafts of the other examples but had a bending strength almost equal to those of the shafts of the other examples at the other points A, B, and C.

It was found that as a result of comparison of the shafts of the examples 2, 4, and 5 in the torsional strength and the directional stability of hit balls, the shaft having the fullerene-containing bias layer formed at the head-side tip portion thereof had a higher torsional strength and a more stable directional stability than the shaft having the fullerene-containing bias layer formed at the grip-side butt portion thereof and the central portion thereof. This is considered as follows: Because the largest stress is applied to the tip portion of the shaft when the ball is hit, the formation of the fullerene-containing bias layer at the head-side tip portion of the shaft is effective for improving the torsional strength and the directional stability of hit balls. This is considered as follows: Because the tip portion of the shaft is subjected to the largest stress when a ball is hit, the formation of the fullerene-containing bias layer at the tip portion of the shaft is effective for improving the torsional strength and the directional stability of the hit balls.

The shaft of the example 2 containing 0.02 wt % of the fullerene had better results than the shaft of the example 1 containing the 0.002 wt % of the fullerene in the directional stability of hit balls and the torsional strength. This is considered as follows: Because The fullerene was contained more in the shaft of the example 2 than in the shaft of the example 1, it is possible to eliminate variations in the strength of the shaft. In addition, the content of the fullerene was large enough to prevent aggregation of the fullerene.

The shaft of the comparison example 4 having the fullerene-containing straight layer at the head-side tip portion and the shaft of the comparison example 5 having the fullerene-containing hoop layer at the head-side tip portion were inferior in the directional stability of hit balls and lower in the torsional strength than the shaft of the example 2 having the bias layer which contained the fullerene in the same amount as that of the shafts of the comparison examples 4, 5 at the head-side tip portion. This indicates that the fullerene and the like disposed in the bias layer is more effective for enhancing the directional stability of hit balls and the torsional strength than the fullerene and the like disposed in the straight layer and the hoop layer.

It was also found that the shaft of the comparison example 4 had a very high bending strength at the point T and that the shaft of the comparison example 5 had a very low bending strength at the point T.

What is claimed is:

1. A golf club shaft composed of a laminate of prepregs each containing a matrix resin and reinforcing fibers impregnated with said matrix resin, wherein said reinforcing fibers of a part of said prepregs layered one upon another incline to an axis of said golf club shaft to form at least one bias layer; fullerene and/or a fullerene compound is mixed with said matrix resin of at least one part of said prepregs composing said bias layer respectively to form at least one fullerene-containing bias layer; each prepreg composing said fullerene-containing bias layer contains said fullerene and/or said fullerene compound at not less than 0.002 wt % nor more than 2 wt % of a weight of said matrix resin; the full length of said golf club shaft is not less than 800 mm nor more than 1270 mm; the fullerene-containing bias layer is interposed between other bias layers having reinforcing fibers that form an angle of ±45° with respect to the axis of the shaft and a straight layer having reinforcing fibers that form an angle of 0° with respect to the axis of the shaft; and said fullerene and/or fullerene compound is contained in said bias layer which is formed at the head-side tip of said golf club shaft in a length of 100 to 500 mm wherein said other bias layers and said straight layer are composed of said laminate of prepregs and do not contain said fullerene or/and said fullerene compound.

2. The golf club shaft according to claim 1, wherein a lower limit of an angle of said reinforcing fibers of said fullerene-containing bias layer to said axis of said golf club shaft is 20° and an upper limit of an angle of said reinforcing fibers of said fullerene-containing bias layer to said axis of said golf club shaft is 70°.

3. The golf club shaft according to claim 1, wherein said fullerene has a surface that is chemically treated with a surface-active agent composed of polyoxyethylene lauryl ether and is mixed with said matrix resin of at least one part of said prepregs composing said bias layer.

4. The golf club shaft according to claim 3, wherein said fullerene compound formed by bonding said fullerene to a functional group selected from a hydroxyl group or metal atoms is mixed with said matrix resin of at least one part of said prepregs composing said bias layer.

5. The golf club shaft according to claim 4, wherein an average diameter of molecules of said fullerene and/or said fullerene compound is not less than 0.6 nm nor than 3.5 nm.

6. The golf club shaft according to claim 1, wherein said fullerene compound formed by bonding said fullerene to a functional group selected from a hydroxyl group or metal atoms is mixed with said matrix resin of at least one part of said prepregs composing said bias layer.

7. The golf club shaft according to claim 1, wherein an average diameter of molecules of said fullerene and/or said fullerene compound is not less than 0.6 nm nor than 3.5 nm.

* * * * *